US009057187B2

(12) United States Patent
Stack et al.

(10) Patent No.: US 9,057,187 B2
(45) Date of Patent: Jun. 16, 2015

(54) ANTI-OVERFLOW TOILET AND METHOD

(71) Applicants: Patrick Gerard Stack, Northville, MI (US); Lawrence Allen Trowbridge, Dripping Springs, TX (US)

(72) Inventors: Patrick Gerard Stack, Northville, MI (US); Lawrence Allen Trowbridge, Dripping Springs, TX (US)

( * ) Notice: Subject to any disclaimer, the term of this patent is extended or adjusted under 35 U.S.C. 154(b) by 204 days.

(21) Appl. No.: 13/658,457

(22) Filed: Oct. 23, 2012

(65) Prior Publication Data

US 2013/0104305 A1 May 2, 2013

Related U.S. Application Data

(63) Continuation-in-part of application No. 12/815,151, filed on Jun. 14, 2010, now Pat. No. 8,590,068, which is a continuation of application No. 11/217,217, filed on Sep. 2, 2005, now Pat. No. 7,757,312.

(51) Int. Cl.

| | |
|---|---|
| ***E03D 11/02*** | (2006.01) |
| ***E03D 11/00*** | (2006.01) |
| ***E03D 11/13*** | (2006.01) |
| *E03D 13/00* | (2006.01) |

(52) U.S. Cl.

CPC ..... *E03D 11/00* (2013.01); *Y10T 29/49826* (2015.01); *E03D 11/13* (2013.01); *E03D 13/005* (2013.01)

(58) Field of Classification Search

USPC ..... 4/317, 342, 427

See application file for complete search history.

(56) References Cited

U.S. PATENT DOCUMENTS

| | | | |
|---|---|---|---|
| 3,262,132 | A | 7/1966 | Mann |
| 3,411,162 | A | 11/1968 | Palmer |
| 4,028,747 | A | 6/1977 | Newton |
| 4,204,285 | A | 5/1980 | Pak |
| 6,944,892 | B1 | 9/2005 | Giolas |
| 7,383,594 | B1 | 6/2008 | Giesken et al. |
| 2004/0231039 | A1 | 11/2004 | Turkman et al. |
| 2005/0000005 | A1 | 1/2005 | Giesken et al. |
| 2007/0294815 | A1 | 12/2007 | Stack et al. |

*Primary Examiner* — Tuan N Nguyen

(74) *Attorney, Agent, or Firm* — Vincent Re PLLC

(57) ABSTRACT

A toilet fixture includes a bowl, a primary drain fluidly connected to the bowl, a supply water plenum providing water to the bowl to flush the fixture, and a secondary drain inlet located to the plenum. The secondary drain inlet includes a secondary drain hole permitting water to flow from the plenum into the secondary drain inlet. The secondary drain inlet is fluidly connected to a drain permitting water to exit the fixture and water flowing through the secondary drain inlet can bypass a clog in the primary drain.

6 Claims, 6 Drawing Sheets

ANTI-OVERFLOW TOILET AND METHOD

CROSS REFERENCE TO RELATED APPLICATIONS

This disclosure is continuation-in-part of and claims priority to U.S. application Ser. No. 12/815,151 filed on Jun. 14, 2010 which is a continuation of and claims priority to U.S. application Ser. No. 11/217,217 filed on Sep. 2, 2005, both of which are hereby incorporated by reference.

TECHNICAL FIELD

This disclosure relates to an improved bathroom fixture for flushing bodily waste materials into a drainage or sewer system. More particularly, this disclosure includes a toilet having a secondary drainage system that prevents the fixture from overflowing.

BACKGROUND

The statements in this section merely provide background information related to the present disclosure. Accordingly, such statements are not intended to constitute an admission of prior art.

Traditional bathroom fixtures, such as toilets and urinals, may become blocked or plugged-up resulting in the flushing water and waste to overflow when the fixture is flushed. Obviously, this overflow of water and waste materials is undesirable and there is therefore a need for an improved bathroom fixture that prevents these overflows from occurring.

There have been previous attempts to prevent a blocked toilet from overflowing. These prior art anti-overflow devices are often complicated and require modification to existing plumbing within the house or building.

Some prior art references pertaining to toilet overflow devices and systems include U.S. Pat. No. 3,411,162 issued Nov. 19, 1968 to Norbert J. Palmer for "Toilet Bowl Construction"; U.S. Pat. No. 4,204,285 issued May 27, 1980 to Ian T. Pak for "Overflow Protection Apparatus"; U.S. patent publication 2005-0000005 filed May 1, 2003 by Chris Giesken et al. for "Toilet Overflow Prevention System"; and U.S. patent publication 2004-0231039 filed Apr. 22, 2003 by Samsam U. Turkman for "Stink-Free Non-Overflow Automatic Toilet".

Generally such prior art fail to provide for a simple and cost-effective means for preventing bathroom fixtures from overflowing while being readily installed in place of an existing model toilet or urinal without modification to the plumbing of the building.

SUMMARY

A toilet fixture includes a bowl, a primary drain fluidly connected to the bowl, a supply water plenum providing water to the bowl to flush the fixture, and a secondary drain inlet located to the plenum. The secondary drain inlet includes a secondary drain hole permitting water to flow from the plenum into the secondary drain inlet. The secondary drain inlet is fluidly connected to a drain permitting water to exit the fixture and water flowing through the secondary drain inlet can bypass a clog in the primary drain.

BRIEF DESCRIPTION OF THE DRAWINGS

One or more embodiments will now be described, by way of example, with reference to the accompanying drawings, in which.

DETAILED DESCRIPTION

Figure 1:
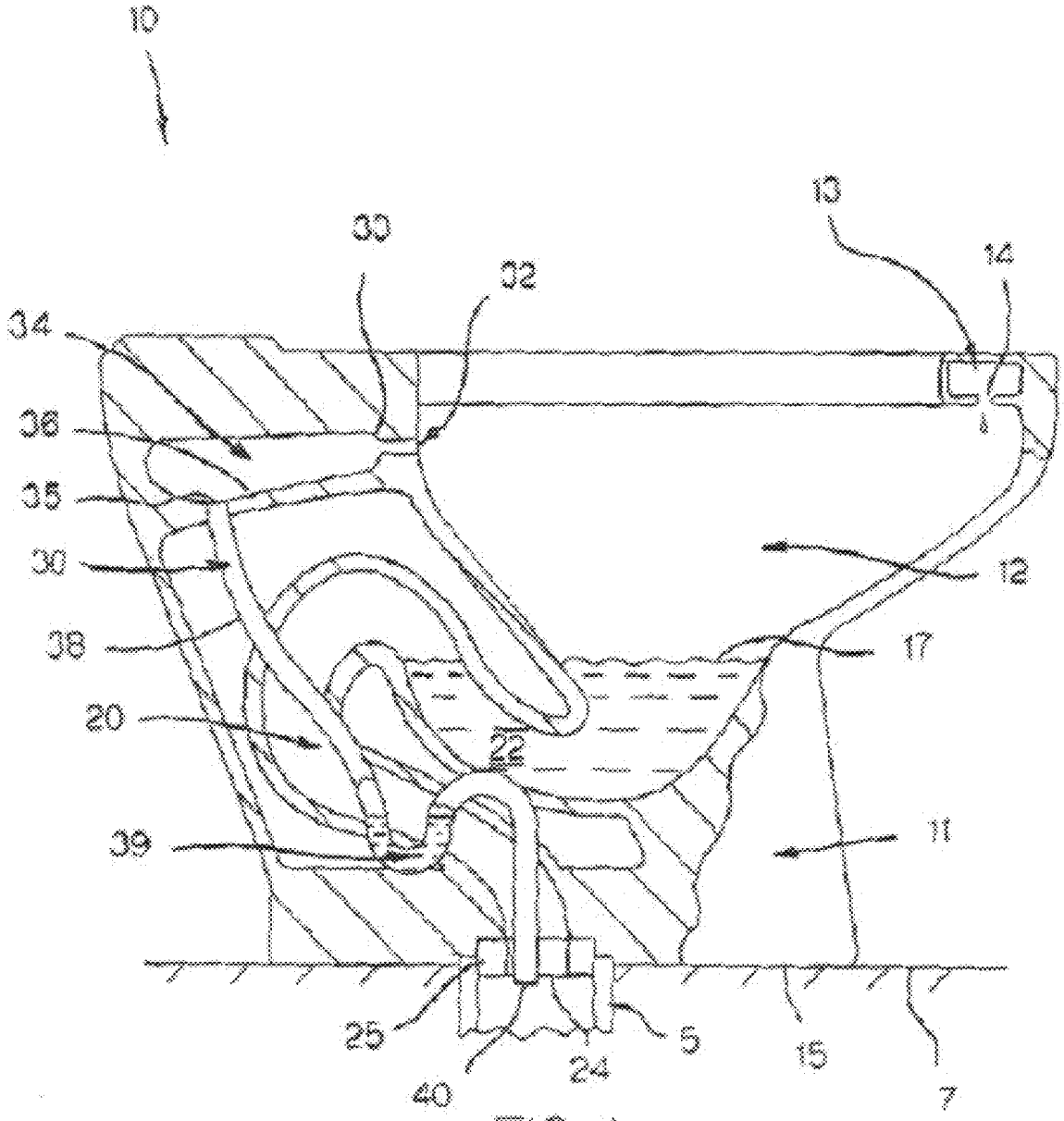
FIG. 1 is a partial cross-sectional side view of an anti-overflow fixture, in accordance with the present disclosure.
Figure 2:
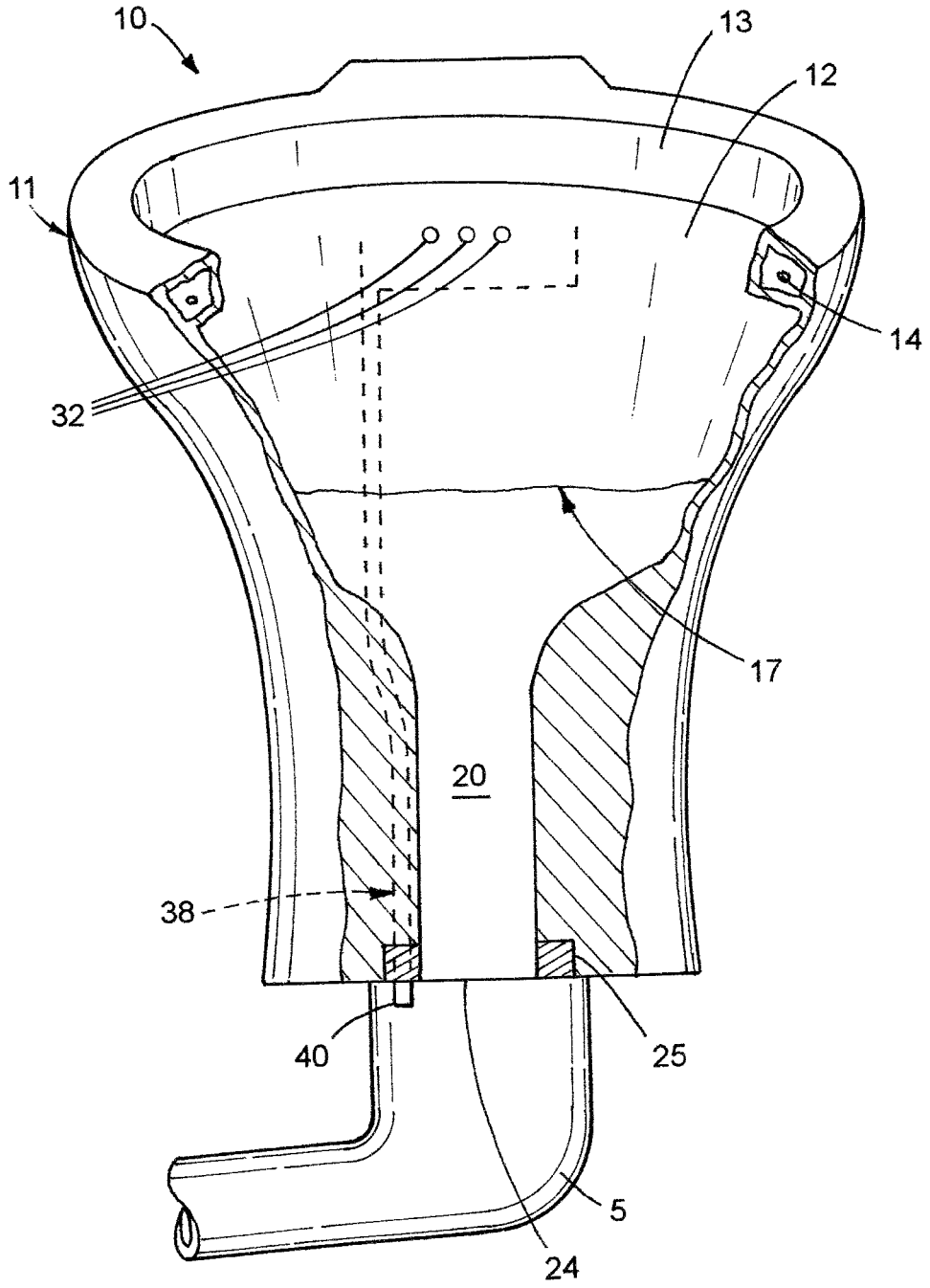
FIG. 2 is a partial cross-sectional front view of the anti-overflow fixture shown in FIG. 1, in accordance with the present disclosure.

Referring now to the drawings, wherein the showings are for the purpose of illustrating certain exemplary embodiments only and not for the purpose of limiting the same, improved bathroom fixtures 10, 110 for flushing bodily waste materials into a sewer system, hereinafter referred to as "bathroom fixture" or "fixture," are shown.

Each fixture 10 has a traditional primary drain 20 and a secondary anti-overflow drain 30. Similarly, each fixture 110 has a traditional primary drain 120 and a secondary anti-overflow drain 30.

With the exception of the novel secondary anti-overflow drain 30, the fixtures 10, 110 are substantially the same in size, shape, configuration, and operation as a conventional toilet or urinal respectively.

Particularly, each fixture 10, 110 includes the following standard features commonly found in conventional toilets and urinals: a structural body or base 11 containing a generally annular-shaped bowl or basin 12 that receives the waste material and a respective primary waste drain system 20, 120 that is in fluid communication with the basin 12. Each drain 20, 120 is configured having a series of bends that form a liquid trap 22. This trap 22 operates to cause an amount of water to remain within the basin 12 after each time the fixtures 10, 110 are used or flushed. It should be appreciated that the waterline 17, i.e., the height of the amount of water left in the basin 12 after each flush, is determined by the relative volumes of the basin 12 and the primary drain pipes 20, 120 and the height that trap 22 extends upward relative to the basin 12.

Figure 3:
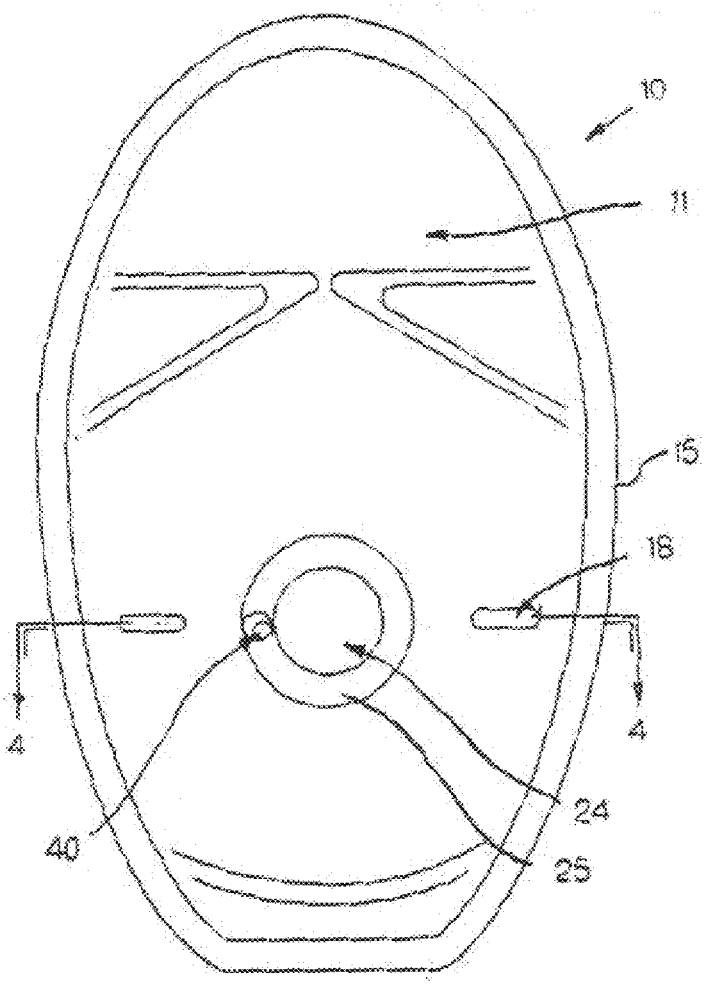
FIG. 3 is bottom view of the anti-overflow fixture shown in FIGS. 1 and 2, in accordance with the present disclosure.
Figure 4:
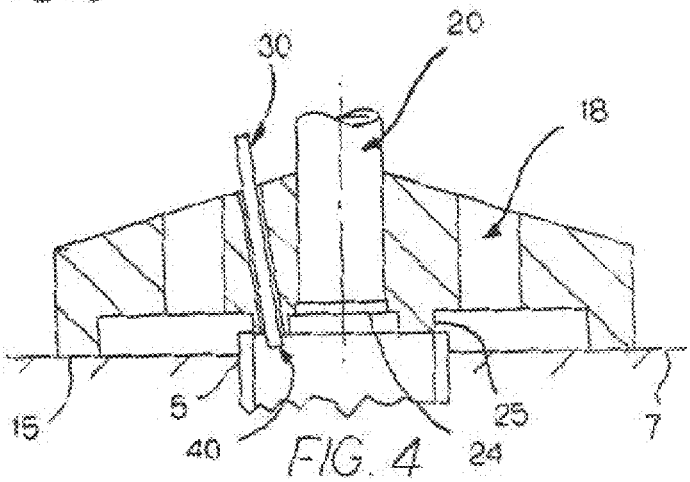
FIG. 4 is a view through section 4-4 shown in FIG. 3, in accordance with the present disclosure.
Figure 5:
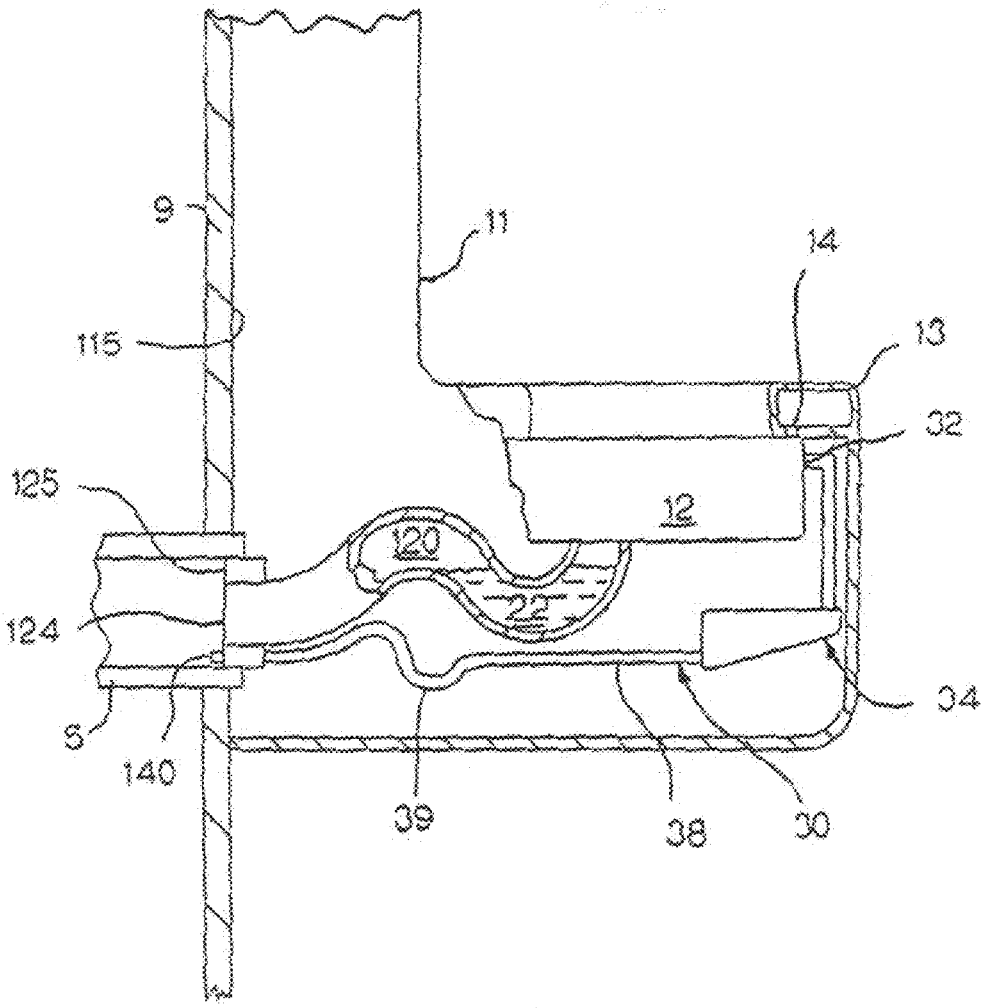
FIG. 5 is a partial cross-sectional side view of an anti-overflow fixture according to an alternate embodiment, in accordance with the present disclosure.

It should be readily apparent that in the embodiment of the disclosure depicted in FIGS. 1-4, the body 11 of bathroom fixture 10 is a toilet and in FIG. 5, the body 11 of bathroom fixture 110 is a urinal.

A tank or source of flushing water (not shown) of conventional design is fluidly coupled to the fixtures 10, 110 to provide the water needed to flush the contents of fixtures 10, 110. The tank may be located in substantially any position relative to the fixtures 10, 110. For example, the tank may be physically mounted directly to the fixtures 10, 110 or at a remote position. Similarly, a pressurized water line and a check valve system may be employed in place of the tank system as a source of flushing water.

Further, each fixture 10, 110 also includes a rim 13 which define the upper edge of basin 12. Rim 13 includes a plurality of flush water outlets 14. These flush water outlets 14 are fluidly coupled to a source of flushing water, such as the above-described tank. The outlets 14 are oriented to direct an amount of flushing water to cascade down the basin 12 each time the fixtures 10, 110 are flushed. As the rim 13 and outlets 14 are conventional they will not be discussed in any greater detail.

Openings 18 for fastening the body 11 of the fixture are formed through the portion of the body 11 in close proximity to the bathroom's mounting surface (i.e., the floor or wall). These openings 18 permit conventional hardware or fasteners to fixedly hold the body 11 to that bathroom surface.

It should be appreciated that in the fixture 10, which has its body 11 configured as a toilet, a seat (not shown) is normally mounted upon the rim 13.

With respect to fixture 10 and as is best shown in FIGS. 3 and 4, drain 20 terminates at a primary discharge port 24 located in close proximity to the bottom edge 15 of the fixture 10. Primary discharge port 24 includes a cylindrical collar 25 that is sized to slide into the opening of a standard sanitary line or plumbing 5 that is normally found beneath a bathroom floor 7. It should be appreciated that plumbing 5 is a length of conventional pipe that is usually orthogonal to the floor and terminates either even with or projects slightly above the level of floor 7. In combination with a conventional sealing material, such as a wax ring, the primary discharge port 24 and plumbing 5 are fluidly coupled to enable drain 20 to act as the primary means for flushing waste material down the fixture 10.

As shown in FIGS. 1-4, the preferred embodiment of the bathroom fixture is configured as a toilet. Fixture 10 includes a secondary drain 30 that is fluidly coupled to the basin 12 through a plurality of inlet holes 32 formed in the back wall of the basin 12. These holes 32 are formed in the basin 12 at a location that is above the typical waterline 17 of the fixture 10. Each of the inlets 32 are located below the flush water outlets 14 found in the rim 13.

In the preferred embodiment of the disclosure, there are three to five inlet holes 32 that are each approximately ⅜ inch in diameter. In one embodiment, the holes 32 are disposed in a line that is substantially parallel to the waterline 17 and located approximately one to three inches beneath the rim 13. This location of the holes 32 ensures that waste water will not enter holes 32 unless there is a blockage (i.e., when waste water backs up toward the top of the basin 12), while concomitantly receiving a small amount of the water being emitted from the flush water outlets 14 during each flush to keep the drain 30 relatively clean and preventing the water in the drain 30 from becoming stagnant.

The location, quantity, size, shape and orientation relative to each other of the inlet holes 32 may vary and holes 32 need only be disposed below the outlets 14 and above the waterline 17 to operate as inlets for secondary drain 30.

In the preferred embodiment of the disclosure, secondary drain 30 also includes an overflow reservoir 34. Reservoir 34 is an enclosed generally rectangular member that is disposed in the body 11 of fixtures 10, 110. Reservoir 34 has a front side 33 that is in fluid communication with each of the inlet holes 32. The bottom or floor 36 of reservoir 34 angles downward away from front side 33 and inlets 32 and terminates at an outlet hole 35 located at the lowest point of reservoir 34. As shown, reservoir 34 is shaped to receive any liquid from inlets 32 and funnel that liquid toward the outlet hole 35 formed in the bottom of the reservoir.

Drain 30 further includes an overflow drain tube 38. In the preferred embodiment of the disclosure, drain 38 is approximately one-half inch in inside diameter and is fluidly coupled to the outlet hole 35.

Drain 38 extends down the body 11 to a secondary discharge port 40. As shown best in FIGS. 3 and 4, secondary discharge port 40 passes through an aperture formed in the collar 25 and extends approximately one-half to one inch beyond the collar 25. When coupled to a standard drain 5, the extended length of port 40 beyond the collar 25 causes the secondary drain 30 to physically project into the plumbing 5 beyond the primary discharge port 24 of primary drain 20.

Drain tube 38 is configured having a series of bends that form a liquid trap 39. This trap 39 is disposed along the length of tube 38 between the outlet hole 35 and the secondary discharge port 40. Trap 39 operates to cause an amount of water to remain within the drain tube 38 after each time fixtures 10, 110 are used or flushed. This trapped water in drain tube 38 prevents sewer gases and odors from passing through the secondary drain 30 into the lavatory.

Referring now to FIG. 5, an alternative embodiment of the disclosure is shown whereby the body 11 of the fixture 110 is shaped as a urinal. With the exception of the shape of the body 11 and the following changes due to the normal wall mounting of a urinal instead of the conventional floor mounting of a toilet, the components, configuration, and operation of the disclosure is identical to that described above with like parts having like reference numbers.

In fixture 110, the primary drain 120 terminates at a primary discharge port 124 located in close proximity to the back edge 115 of the fixture 110. Primary discharge port 124 includes a cylindrical collar 125 that is sized to slide into the opening of a standard sanitary line or plumbing 5 that is normally found behind a bathroom wall 9. It should be appreciated that plumbing 5 is a length of conventional pipe that is usually orthogonal to the wall and terminates either even with or projects slightly beyond the wall 9.

As shown in FIG. 5, the drain tube 38 extends down the body 11 to a secondary discharge port 140. Secondary discharge port 140 passes through an aperture formed in the collar 125 and extends approximately one-half to one inch beyond the collar 125. When coupled to a standard drain 5, the extended length of port 140 beyond the collar 125 causes the secondary drain 30 to physically project into the plumbing 5 beyond the primary drain 120.

Figure 6:
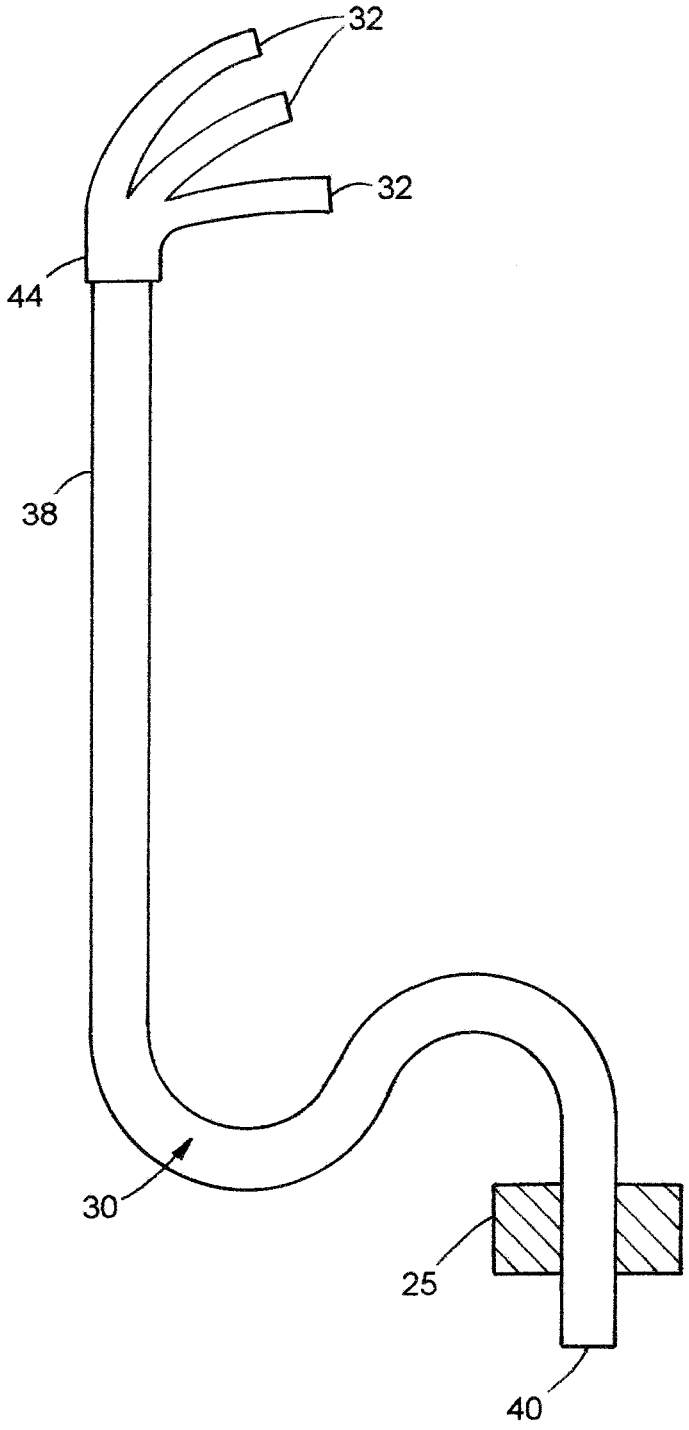
FIG. 6 is a view of the secondary drain of an anti-overflow fixture according to an alternate embodiment, in accordance with the present disclosure.

Referring now to FIG. 6, an alternative embodiment of the secondary drain 30 is shown wherein the reservoir 34 is eliminated and is replaced by a pipe union 44. Union 44 is fluidly coupled to each of the inlet holes 32 at one end and to the drain tube 38 at the other.

In operation, when the primary drains 20, 120 become obstructed or blocked, the flushing water and waste material will begin to back up toward the top of the basin 12. The secondary drain 30 redirects the backed-up liquid back to the sewer 5 in the following manner:

Once the liquid backs up to the height of the inlet holes 32, the liquid will flow through these inlets 32 and collect in the reservoir 34. The angled shape of reservoir 34 causes the liquid to flow down through the outlet 35 into the overflow drain tube 38. The liquid flows through the drain tube 38 and passes out of the secondary drain 30 through the respective secondary discharge port 40, 140 that extends into the sewer plumbing 5 beyond the obstructed primary drains 20, 120.

Thus it is understood that I have described an improved bathroom fixture having a secondary anti-overflow drain which may be readily installed in place of substantially any previous fixture (i.e., toilet or urinal) without any modification to the current plumbing or sewer system.

It should be appreciable to one skilled in the relevant art that the above described improved bathroom fixture may be made from various materials and be configured in various shapes and sizes without going beyond the scope and intent of the present disclosure.

In the preferred embodiment, the fixture is made from a ceramic material such as porcelain. In other embodiments the fixture may be formed from other hard, durable, and waterproof materials, such as plastic or metal.

In one embodiment of the disclosure, the secondary drain 30 is integrally formed within the body structure 11 of the fixture. For example, the drain 30 could be cast directly into the mold of a body 11 made of porcelain.

In other embodiments, however, the secondary drain 30 may be a system of components separate from the structural body 11 of the fixture. That is, secondary drain 30 may be removably coupled to the basin 12 and body 11 to facilitate ease of manufacture or cost considerations. In this alternative preferred embodiment, drain 30 may be partially formed from conventional pipe material such as metal or plastic pipe.

In still other embodiments, some components of the secondary drain 30 may be integrally formed with the body 11, such as inlets 32, while other portions of the secondary drain, such as reservoir 34, overflow drain tube 38, and secondary discharge ports 40, 140 may be coupled to the body 11 to define the fixture.

In still yet other embodiments, the drain tube 38 and trap 39 may be mounted external to the body 11 and wherein a first end of the drain tube 38 extends through the body 11 to fluidly communicate with the inlet means 32, and the opposite end of the overflow drain tube 38 also extends through another aperture formed in the body 11 to fluidly communicate with the discharge port 40, 140.

In still yet other embodiments, the secondary drain 30 may be provided as separate components that are disposed within openings and passages formed within the body 11, effective to hide the secondary drain 30 within the body 11.

Figure 7:
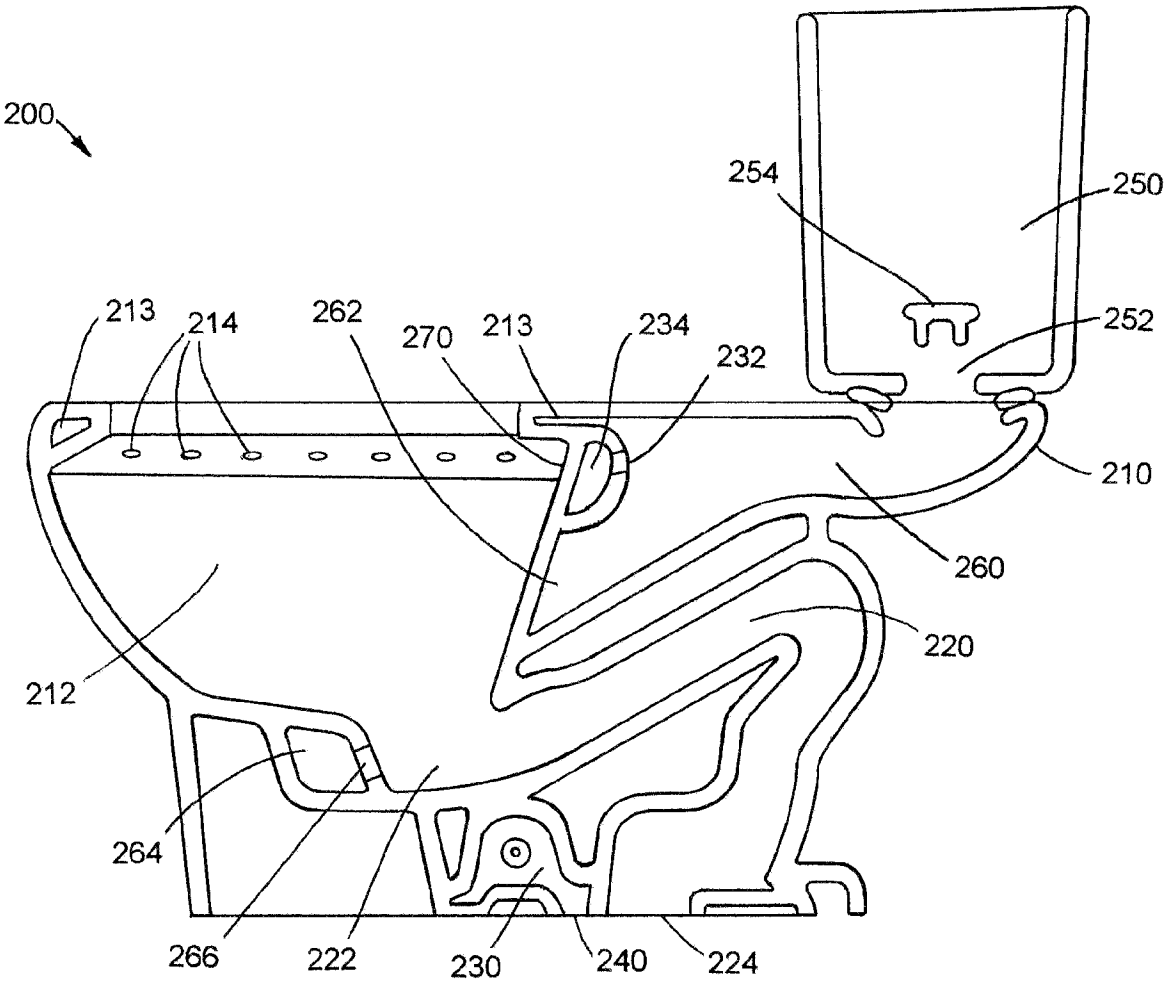
FIG. 7 is a cross-sectional view of an additional embodiment of the disclosure wherein a hole internal to a supply water plenum provides a secondary drain to a fixture, in accordance with the present disclosure.

FIG. 7 illustrates in cross-section an additional embodiment of the disclosure wherein a hole internal to a supply water plenum provides a secondary drain to a fixture. Configuration 200 includes fixture 210 with a water tank 250, a bowl 212, and a primary drain 220. Water is held in water tank 250 by tank valve 254. Once tank valve 254 is opened, water rushes according to the pull of gravity through tank hole 252 and enters supply water plenum 260 of fixture 210. In another embodiment, a flushometer-type valve can be used with a tank-less toilet, wherein depression of the valve causes a surge of water to enter supply water plenum 260. A wide variety of toilet designs are envisioned for use with the configurations disclosed herein, and the disclosure is not intended to be limited by the particular examples provided. Supply water plenum 260 receives the flow of water from tank 250 and channels the water flow to different destinations for the purpose of flushing the fixture, emptying contents of the bowl, and refilling the bowl after the flush. A portion of the water flow within supply water plenum 260 is channeled to a channel 213 circumventing the rim of bowl 212. Water within channel 213 flows through holes 214 and into bowl 212. A portion of the water flow within supply water plenum 260 is channeled through passage 262 which progresses around the bowl and fluidly connects with jet channel 264. Water exits jet channel 264 through hole 266 to provide flushing action/head pressure to primary drain 220 at primary drain inlet 222. Water and waste from bowl 212 and water from jet channel 264 enter primary drain 220 and flush through the primary drain 220 as the column of water and waste create a siphon in accordance with operation of a fixture as is known in the art. The water and waste exit the fixture through primary drain outlet 224. Primary drain outlet 224 is coupled to a structure sewage pipe channeling the waste to other sewage pipes and subsequently out of the structure.

A secondary drain inlet 234 is illustrated within supply water plenum 260. A secondary drain hole 232 permits water to flow from the supply water plenum 260 into secondary drain inlet 234. One secondary drain hole 232 can be provided or a plurality of secondary drain holes 232 can be provided. One having skill in the art will appreciate that the primary drain 220 and bowl 212 are configured such that during normal operation, water fills in the bowl 212 until a corresponding water level within primary drain 220 causes water filling fixture to overflow the bend in primary drain 220. In this way, a normal water level for the bowl 212 to achieve during a filling cycle of the fixture is set. Because a corresponding water level also fills within supply water plenum 260, it is noted that any secondary drain holes 232 should be located above the bend in primary drain 220 such that water will not drain from the water supply plenum 260 through the secondary drain inlet 234 when the bowl is filled to a normal designed level.

Secondary drain inlet 234 is fluidly connected to secondary drain channel 230. A channel can travel integrally within fixture 210 to connect the secondary drain inlet 234 and the secondary drain channel 230. A channel connecting the secondary drain inlet 234 and the secondary drain channel 230 can include a water trap according to plumbing methods known in the art. Water within secondary drain channel 230 can exit the fixture through secondary drain outlet 240. In another embodiment, secondary drain channel 230 can be configured to empty into the primary drain 220 just above primary drain outlet 224. Primary drain outlet 224 and secondary drain outlet 240 can be configured to connect to a standard plumbing connection known in the art. Water can be channeled from supply water plenum 260 into secondary drain inlet 234 for the purpose of flushing the secondary drain and cleaning it out.

If a clog in primary drain 220 prevents water and waste from exiting bowl 212, the water level in bowl 212 rises. One having skill in the art will appreciate that as the water level in bowl 212 rises, a water level within the supply water plenum 260 will also rise. As the water level within the plenum reaches secondary drain hole 232, water enters secondary drain inlet 234, flows to secondary drain channel 230, and flows out of secondary drain outlet 240. By flowing through the secondary drain, water from the supply water plenum 260 bypasses the clog in the primary drain 220 and prevents the fixture from overflowing out of the bowl.

In addition to secondary drain hole 232, a secondary drain hole or holes can be added to a wall separating the bowl 212 and the secondary drain inlet 234 at point 270. Holes in both the bowl 212 and the supply water plenum 260 leading to the secondary drain can facilitate increased flow bypassing a clog in the primary drain 220, thereby decreasing a chance that the water level in the bowl will rise to a level where overflow outo of the bowl occurs.

Secondary drain hole 232 is illustrated on a vertical wall of secondary drain inlet 234. Different locations of drain hole 232 will change how much water is channeled from the supply water plenum 260 into the secondary drain inlet 234. In one exemplary embodiment, a hole facing a direction that the water is flowing from within the supply water plenum 260 will be more likely to get a large amount of water flowing through the hole. A hole facing away from the direction that the water is flowing from or a hole shielded in some way from the flow of water within the plenum can get a reduced amount of water flowing through the hole. A combination of hole locations can be used, for example, with a single hole located to receive a large amount of water to facilitate flushing out the secondary drain and with two other holes shielded from the flow within plenum to reduce how much water is channeled from the plenum through the holes but still receiving water when the water level in the bowl and plenum begins to rise due to a clog. Locations, orientations, sizes, and numbers of secondary drain holes can be determined experimentally, through computerized modeling, or by any method sufficient to contemplate flow of water through an exemplary fixture.

Secondary drain holes can be formed integrally with the wall during the process of constructing the fixture, for example, prior to the porcelain material being heated, or the secondary drain holes can be added to the walls of the fixture through a drilling process after the construction of the fixture.

The embodiment of FIG. 7 includes jet channel 264. Some toilet fixtures include a water jet channel and some do not. A secondary drain inlet within a supply water plenum can still work within a fixture wherein water only enters the bowl through holes around the rim. However, water from the rising level in the bowl will not enter the plenum until the water level exceeds the height of the holes around the rim. In such a exemplary configuration, larger holes around the rim and/or a portion of holes around the rim placed lower in the bowl could facilitate water flowing from a bowl back into the plenum before the water level gets too high in the bowl.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A toilet fixture that is fluidly coupled to a sewer drainage pipe, said fixture comprising:

a bowl having a waste receiving basin that includes an upper rim and which holds an amount of water at a certain water level and a supply water plenum providing said water to said basin;

a primary drain fluidly connects said basin and which terminates at a drain passage, a cylindrical outer surface and a thickness between said outer surface and said inner surface and is fluidly coupled to said sewer drainage pipe; and a secondary drain fluidly connects said supply water plenum to said sewer drainage pipe, said secondary drain is separate from said primary drain and including:

inlet means that are disposed within said supply water plenum at a location above said certain water level of said basin;

a second drain channel, in fluid communication with said inlet means, having a water trap; and a second drain outlet that is in fluid communication with said second drain channel, whereby said inlet means permits rising waste water to flow from said supply water plenum into said second drain channel and out of said second drain outlet to said sewer drainage pipe separately from the waste water of the primary drain.

2. The fixture of claim 1, wherein the inlet means comprises a plurality of secondary drain holes.

3. The fixture of claim 2, wherein a first portion of the secondary drain holes faces a direction that water is flowing from within the supply water plenum, providing a water flow within the secondary drain during normal operation of the fixture and permitting bypass of the primary drain when the clog is present; and wherein a second portion of the secondary drain holes is shielded from water flowing within the supply water plenum, permitting bypass of the primary drain when the clog is present.

4. The fixture of claim 1, further comprising a jet channel; and wherein the secondary drain is configured to drain water backing up through the jet channel.

5. The fixture of claim 1, wherein the secondary drain is configured to drain water backing up through holes in a rim of the bowl.

6. The fixture of claim 1, wherein the inlet means faces a direction that water is flowing from within the supply water plenum, providing a water flow within the secondary drain during normal operation of the fixture.

* * * * *